US005791626A

United States Patent [19]

Reese

[11] Patent Number: 5,791,626

[45] Date of Patent: Aug. 11, 1998

[54] PUMP TREE STAND

[75] Inventor: Tim Reese, Aloha, Oreg.

[73] Assignee: Night Before Christmas, LLC, Lake Oswego, Oreg.

[21] Appl. No.: 753,511

[22] Filed: Nov. 26, 1996

[51] Int. Cl.[6] ..... F16M 13/00

[52] U.S. Cl. ..... 248/523; 248/524; 47/40.5

[58] Field of Search ..... 248/523, 519, 248/514, 527, 346.01, 522, 524, 314; 47/40.5

[56] References Cited

U.S. PATENT DOCUMENTS

| | | | |
|---|---|---|---|
| 2,504,455 | 4/1950 | Ruetz | 248/44 |
| 2,913,202 | 11/1959 | Meldrum | 248/44 |
| 4,408,415 | 10/1983 | Davis et al. | 47/40.5 |
| 4,699,347 | 10/1987 | Kuhnley . | |
| 4,750,702 | 6/1988 | Neil et al. . | |
| 4,913,395 | 4/1990 | Juhas . | |
| 5,114,113 | 5/1992 | Krinner . | |
| 5,137,246 | 8/1992 | Idso . | |
| 5,375,808 | 12/1994 | Roy . | |
| 5,467,959 | 11/1995 | Behringer . | |

OTHER PUBLICATIONS

U.S. Application No. 08/540,260 filed Oct. 6, 1995 for "Tree Stand," applicant Eric V. Carlson.

*Primary Examiner*—Leslie A. Braun
*Assistant Examiner*—Willie Berry, Jr.
*Attorney, Agent, or Firm*—Chernoff, Vilhauer, McClung & Stenzel

[57] ABSTRACT

A tree stand of the present invention includes a base defining a tree area, at least one positioning jaw, and at least one securing jaw. The tree stand also includes a pneumatic actuator assembly that actuates the securing jaw in a first direction into the tree area. When the jaws are against the tree they form a clamp that holds the tree upright in the tree area. The tree stand also includes a pneumatic release valve assembly that actuates the securing jaw in a second direction out of the tree area.

18 Claims, 7 Drawing Sheets

PUMP TREE STAND

BACKGROUND OF THE INVENTION

The present invention relates to a pump tree stand intended to be used primarily as a Christmas tree stand.

There are many known tree stands on the market. However, erecting trees for viewing with these tree stands generally requires wrangling with tree limbs, hammering or screwing a spike into a tree trunk, or adjusting complicated strap mechanisms. Other problems with known tree stands include that the stands are often complicated to use, fragile, or limited to specific tree size.

There are several known clamping tree stands. For example, U.S. Pat. No. 2,913,202 to Meldrum and U.S. Pat. No. 4,913,395 to Juhas both have at least two individually adjustable plates or brackets which essentially function as clamping jaws. U.S. Pat. No. 2,504,455 to Ruetz and U.S. Pat. No. to Behringer also disclose clamping tree stands.

There are also several known foot operated clamping tree stands that are generally easier to use than other known systems. For example, U.S. Pat. No. 5,375,808 to Roy and U.S. Pat. No. 5,114,113 to Krinner disclose clamping-type tree stands that may be foot operated. Also, U.S. patent application Ser. No. 08/540,260 discloses a foot operated Christmas tree stand.

Ideally, what is needed is a tree stand that has a simple, foot operated opening mechanism or an initial open position. The tree could then be easily inserted into the stand. Finally, the ideal tree stand should have a simple, foot operated closing mechanism that would be sturdy enough to prevent the tree from falling over. The tree stand should be suitable for quick erection of a tree, easy to use, sturdy, and inexpensive to produce.

BRIEF SUMMARY OF THE INVENTION

A tree stand of the present invention preferably includes a base defining a tree area, at least one positioning jaw, and at least one securing jaw. The jaws preferably project into the tree area. The tree stand also includes a pneumatic actuator assembly that actuates the securing jaw in a first direction further into the tree area. When the jaws are against the tree they form a clamp that holds the tree upright in the tree area. Preferably the tree stand also includes a pneumatic release valve assembly that actuates the securing jaw in a second direction out of the tree area.

As shown, the pneumatic actuator assembly and the pneumatic release valve assembly are preferably foot activatable so that the tree may be inserted while the user is in a standing position.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
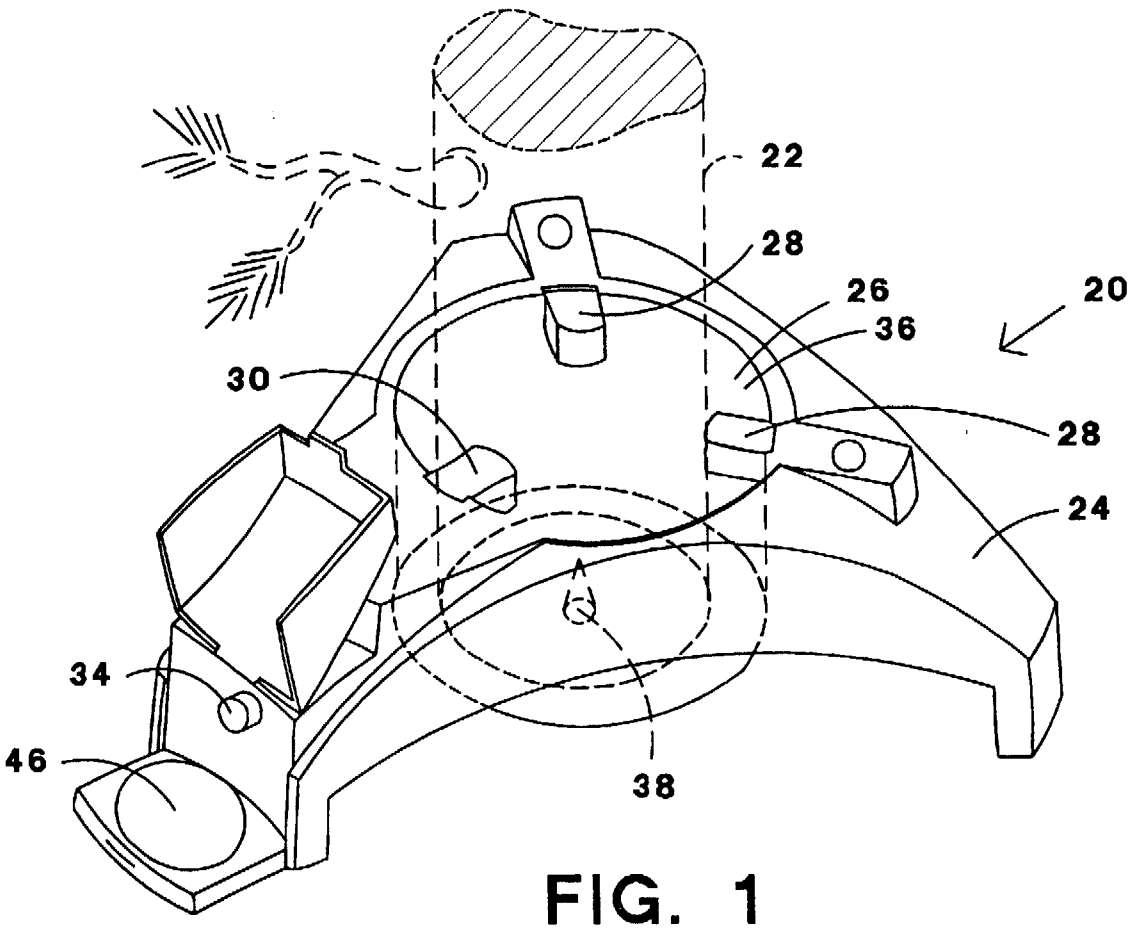
FIG. 1 is a perspective view of a tree stand of the present invention supporting a tree.
Figure 2:
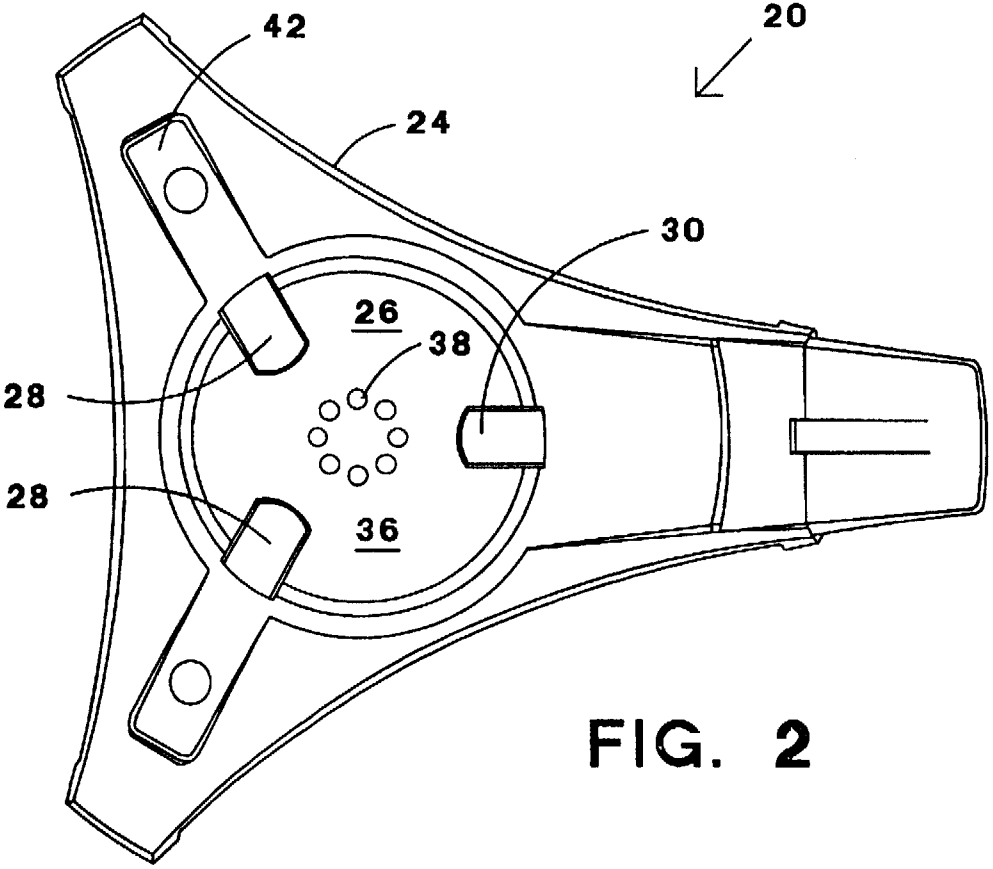
FIG. 2 is a top view of the tree stand of the present invention.

FIGS. 1 and 2 show a tree stand 20 of the present invention supporting a tree 22 (shown in phantom). The tree stand preferably includes a base 24 defining a tree area 26, at least one positioning jaw 28, and at least one securing jaw 30. The jaws 28, 30 preferably project into the tree area 26. The tree stand 20 also includes a pneumatic actuator assembly 32 that actuates the securing jaw 30 in a first direction further into the tree area 26. When the jaws 28, 30 are against the tree 22 they form a clamp that holds the tree 22 upright in the tree area 26. Preferably the tree stand 20 also includes a pneumatic release valve assembly 34 that actuates the securing jaw 30 in a second direction out of the tree area 26.

Figure 3:
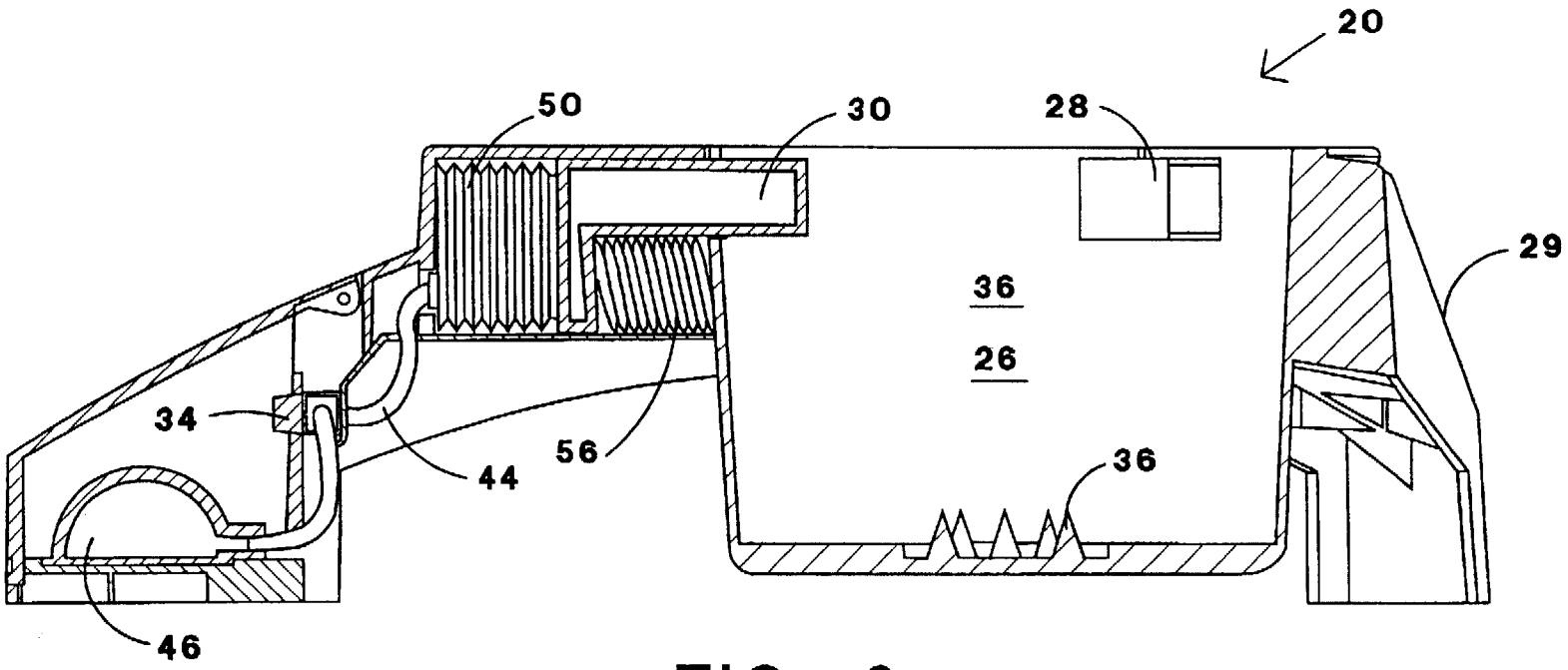
FIG. 3 is a cross-sectional side view of the tree stand in a open position.
Figure 4:
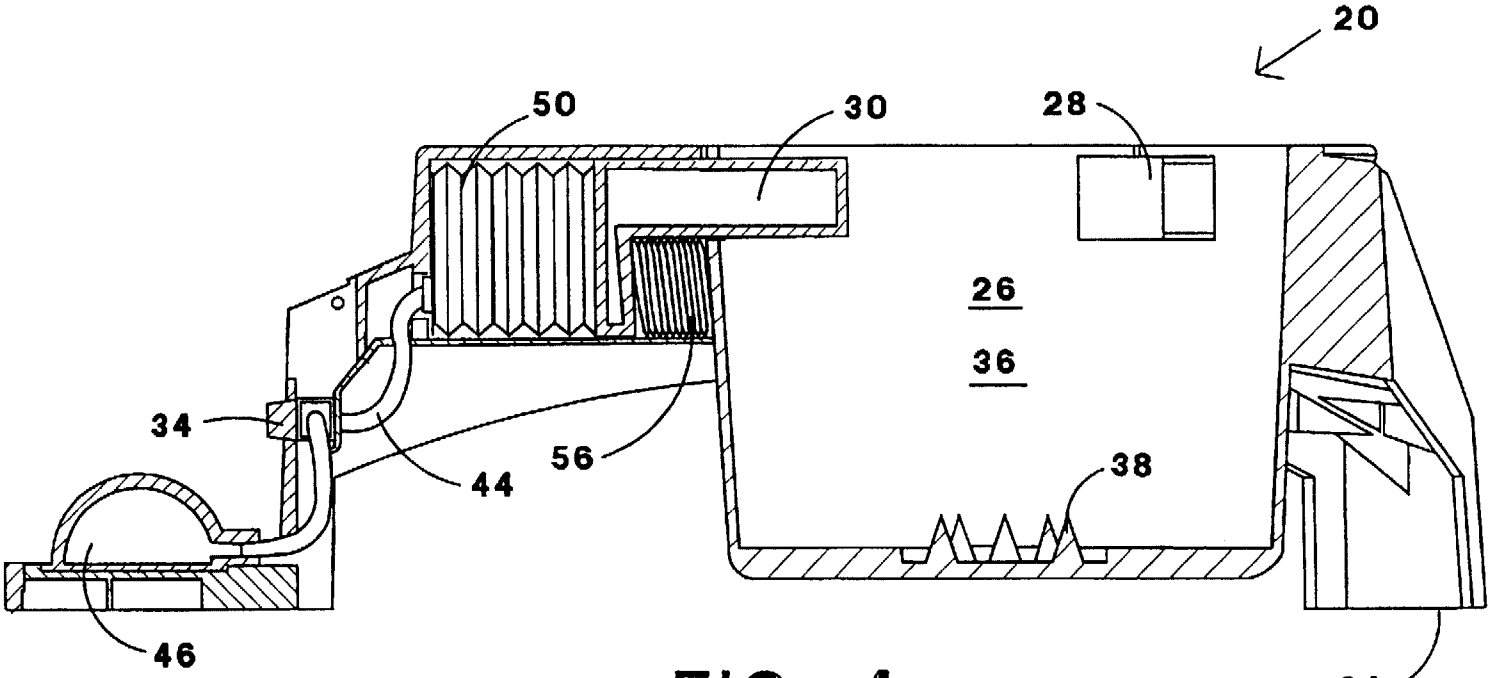
FIG. 4 is a is a cross-sectional side view of the tree sa tree supporting position.

The base 24, as shown in FIGS. 1, 3, and 4 preferably includes a fluid receptacle 36 such as a tub, basin, or bucket section that defines the tree area 26. The fluid receptacle 36 serves as a holder for water for the tree 22 in the tree area 26. Also, the base 24 may include one or more spikes 38 that can be driven into the tree 22 to further secure it within the base 24.

Figure 5:
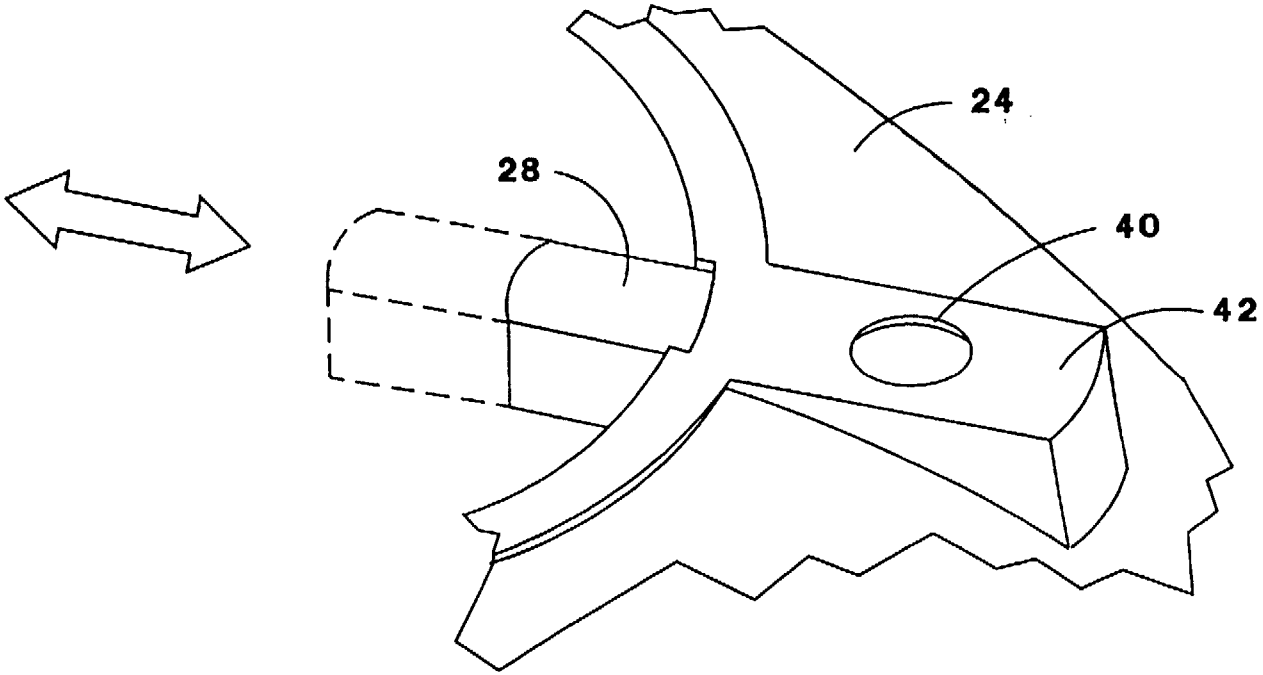
FIG. 5 is a perspective view of a positioning jaw.

The positioning jaws 28 are preferably manually adjustable so that they can be set to project into the tree area 26 at a plurality of distances. The further into the tree area 26 the positioning jaws 28 project, the smaller the tree 22 the tree stand 20 will support. One embodiment of a positioning jaw 28 is shown in FIG. 5. In the shown embodiment a positioning jaw 28 can be adjusted by pressing a button (not shown) set on the top surface of the positioning jaw 28. The button is pressed just below the surface of a cut out 40 in a molded jaw housing 42 of base 24 to release the positioning jaw 28. The positioning jaw 28 can then be manually pulled toward the tree area 26 or pushed back into the jaw housing 42. At predetermined distances alternate buttons (not shown) will pop up.

As mentioned above, the tree stand 20 includes a pneumatic actuator assembly 32 that actuates the securing jaw 30 in a first direction further into the tree area 26. As detailed in FIGS. 6 and 7, one embodiment of the actuator assembly 32 includes an air hose 44, an air pump 46, an air intake valve 48, and an inflatable bladder 50. In this assembly the air pump 46 pulls air through the intake valve 48 and forces it through the air hose 44 into the inflatable bladder 50. The bladder 50 pushes the securing jaw 30 into the tree area 26 as it expands and inflates.

Figure 6:
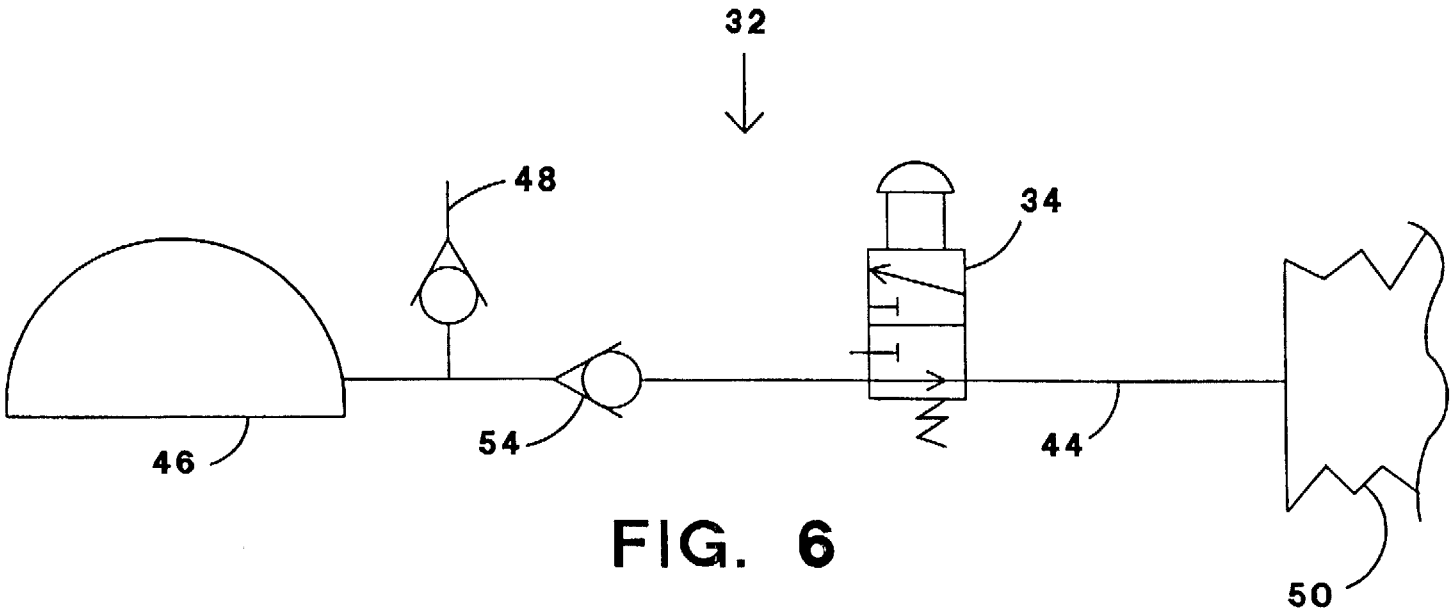
FIG. 6 is an exemplary flow diagram of the pneumatic actuator and release valve assemblies.
Figure 7:
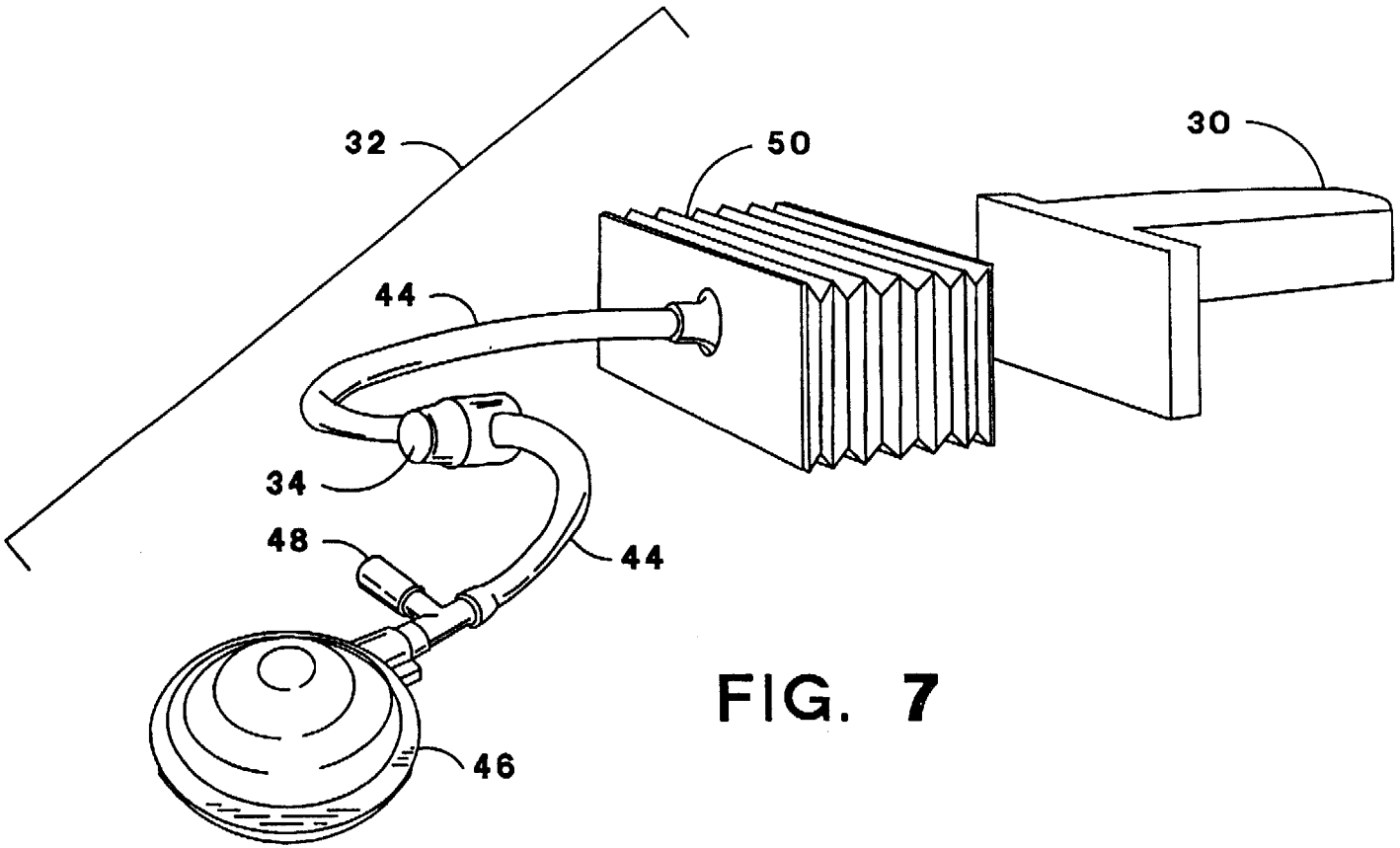
FIG. 7 is a perspective view of the pneumatic actuator and release valve assemblies.

FIG. 6 is a diagram of the pneumatic actuator assembly 32 and the pneumatic release valve assembly 34. The assemblies 32, 34 work together to have at least four states.

The first state is an intake state in which the pump 46, which has already been depressed, is released. As the pump 46 is released, it expands or inflates and thereby draws air into it. During the intake state, the intake valve 48 opens as air is drawn into the pump 46. The check valve 54, however, remains closed.

The second state is a pumping state in which the pump 46 is depressed so that air flows away from it into the hose 44. As air is pushed forward, the intake valve 48 is closed so air cannot escape. Instead, the air flows through the now open check valve 54 and into the bladder 50 causing it to inflate.

The third state is a neutral state in which the pump 46 is neither drawing air or forcing air. In this neutral state, the bladder 50 may be partially full of air that is trying to escape the bladder 50. However, because of the positioning of the check valve 52, the air can only flow one way through it. Accordingly, the air cannot escape from the check valve 52.

In the intake, pumping, and neutral states, the release valve assembly 34 is closed so that air cannot escape. In a fourth state, an air release state, air is meant to escape so that the bladder 50 can deflate. Accordingly, by pressing or kicking the release valve assembly 34 air escapes through the release valve assembly 34. When the bladder 50 deflates, the securing jaw 30 returns to an original position. As shown in FIGS. 3 and 4, an optional spring 56 may be used to push the securing jaw 30 towards the bladder 50 to help deflate it. As air escapes the bladder 50, the spring 56 is able to push the securing jaw 30 out of the tree area 26 so that the tree 22 is released.

As shown in FIG. 3, the tree stand 20 has an open position in which the positioning jaws 28 are at a first distance from the securing jaw 30. In this position, the first distance is set by moving the positioning jaws 28 so that the first distance is greater than the width of the trunk of the tree 22. FIG. 4 shows the tree stand 20 in a tree securing position in which the positioning jaws 28 are at a second distance from the securing jaw 30. The second distance is generally less than the first distance and substantially equal to the trunk width so that the tree 22 is held upright by the positioning jaws 28 and the securing jaw 30.

It is the pneumatic actuator assembly 32 that moves the securing jaw 30 between the open position and the tree securing position. Once in the open position, the tree 22 may be inserted and removed. It is the pneumatic release valve assembly 34 that moves the securing jaw 30 between the tree securing position and the open securing position.

To use the tree stand 20 of the present invention, the tree 22 is inserted into a gap defined by positioning jaws 28 and securing jaw 30 when the stand 20 is in the open position. The pump 46 is then depressed or pumped, preferably using a foot, which causes air to enter the bladder 50. As the bladder 50 inflates it moves the securing jaw 30 in a first direction towards the positioning jaws 28 and thereby narrowing the gap. The securing jaw 30 and the positioning jaws 28 thereby supporting the tree 22 therebetween.

To release the tree 22 from the stand, the pneumatic release valve assembly 34 is actuated or depressed, preferably using a foot. This causes air to escape from the bladder 50. The escape of air, aided by the push of the spring 56 causes the securing jaw 30 to move in a second direction away from the positioning jaws 28 and thereby widening the gap until the stand 20 is in an open position. In the open position the tree 22 can be removed.

As shown, the pneumatic release valve assembly 34 is a push type air release valve such as Sunbeam Part No. 47834-036 which may be purchased from Sankei Co. Ltd. of Ichihara, Chiba, Japan. It should be noted, however, that other release valve assemblies may be used.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A tree stand, comprising:

(a) a base having a tree area;

(b) at least one positioning jaw projecting inward to said tree area;

(c) at least one securing jaw projecting inward to said tree area;

(d) a pneumatic actuator assembly, said pneumatic actuator assembly actuating said at least one securing jaw and adapted to secure said jaws against a tree.

2. The tree stand of claim 1, said tree stand further comprising a pneumatic release valve assembly.

3. The tree stand of claim 2 wherein said pneumatic actuator assembly actuates said at least one securing jaw in a first direction and said pneumatic release valve assembly actuates said at least one securing jaw in a second direction.

4. The tree stand of claim 1 wherein said base includes a fluid receptacle, said fluid receptacle defining said tree area.

5. The tree stand of claim 1 wherein said at least one positioning jaw is an adjustable positioning jaw that can be set to project into said tree area at a plurality of distances.

6. The tree stand of claim 5 wherein said adjustable positioning jaw is manually adjustable.

7. The tree stand of claim 5 wherein said at least one positioning jaw further includes a second adjustable positioning jaw that can be set to project into said tree area at a plurality of distances.

8. The tree stand of claim 1, said pneumatic actuator assembly further comprising:

(a) an air hose;

(b) an air pump;

(c) an intake valve; and (d) an inflatable bladder;

(e) wherein said air pump pulls air through said intake valve and forces it through said air hose into said inflatable bladder.

9. The tree stand of claim 8 wherein said inflatable bladder actuates said at least one securing jaw as it inflates.

10. The tree stand of claim 8 further comprising a pneumatic release valve assembly, said pneumatic release valve assembly is attached to said air hose.

11. The tree stand of claim 1 wherein said pneumatic actuator assembly is a foot activated pneumatic actuator assembly.

12. The tree stand of claim 1 further comprising a foot activated pneumatic release valve assembly.

13. A tree stand for securing a tree having a trunk width, said tree stand having at least one positioning jaw and at least one securing jaw, said tree stand comprising:

(a) an open position in which said at least one positioning jaw is at a first distance from said at least one securing jaw, said first distance being greater than said trunk width;

(b) a tree securing position in which said at least one positioning jaw is at a second distance from said at least one securing jaw, said second distance adopted to be less than said first distance and adopted to be substantially equal to said trunk width; and (c) a pneumatic actuator assembly for moving said at least one securing jaw between said open position and said tree securing position.

14. The tree stand of claim 13 wherein said tree may be inserted and removed when said tree stand is in said open position and said tree trunk is supported between said at least one positioning jaw and said at least one securing jaw when said tree stand is in said tree supporting position.

15. The tree stand of claim 13 wherein said tree stand further comprises a pneumatic release valve assembly, said pneumatic release valve assembly for moving said at least one securing jaw between said tree securing position and said open securing position.

16. A method of supporting a tree in a tree stand comprising the steps of:

(a) inserting said tree into a gap defined by at least one positioning jaw and at least one securing jaw; and (b) moving said at least one securing jaw in a first direction towards said at least one positioning jaw and thereby narrowing said gap by actuating a pneumatic actuator, said at least one securing jaw and said at least one positioning jaw thereby supporting said tree therebetween.

17. The method of claim 16 including the further steps of:

(a) actuating a pneumatic release valve assembly and thereby moving said at least one securing jaw in a second direction away from said at least one positioning jaw and thereby widening said gap; and (b) removing said tree from said gap.

18. The method of claim 16 wherein said step of moving said at least one securing jaw by actuating a pneumatic actuator includes pumping a foot pump.

* * * * *

UNITED STATES PATENT AND TRADEMARK OFFICE

CERTIFICATE OF CORRECTION

PATENT NO. : 5,791,626

DATED : August 11, 1998

INVENTOR(S) : Tim Reese

It is certified that error appears in the above-identified patent and that said Letters Patent is hereby corrected as shown below:

ON THE TITLE PAGE:

Item [75] Inventors: Insert --Keith Layton, Portland, Oreg.-- after "Tim Reese, Aloha, Oreg."

Item [19] "Reese" should read --Reese et al.--.

Signed and Sealed this

Seventeenth Day of August, 1999

*Attest:*

Q. TODD DICKINSON

*Attesting Officer*

*Acting Commissioner of Patents and Trademarks*